US009111699B2

(12) United States Patent
Birner et al.

(10) Patent No.: US 9,111,699 B2
(45) Date of Patent: Aug. 18, 2015

(54) ELECTRICAL SWITCH

(75) Inventors: Jürgen Birner, Amberg (DE); Walter Felden, Rieden (DE); Bernhard Hannich, Hahnbach (DE); Thomas Pniok, Hamburg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 257 days.

(21) Appl. No.: 13/596,555

(22) Filed: Aug. 28, 2012

(65) Prior Publication Data

US 2013/0048481 A1 Feb. 28, 2013

(30) Foreign Application Priority Data

Aug. 29, 2011 (DE) ..... 10 2011 081 736

(51) Int. Cl.

| | |
|---|---|
| ***H01H 1/22*** | (2006.01) |
| ***H01H 3/62*** | (2006.01) |
| ***H01H 1/20*** | (2006.01) |
| *H01H 73/04* | (2006.01) |
| *H01H 77/10* | (2006.01) |

(52) U.S. Cl.

CPC ..... *H01H 3/62* (2013.01); *H01H 1/205* (2013.01); *H01H 73/045* (2013.01); *H01H 77/105* (2013.01)

(58) Field of Classification Search

CPC ..... H01H 1/2041; H01H 1/22; H01H 1/205; H01H 73/045; H01H 77/105

USPC ..... 200/401, 285

See application file for complete search history.

(56) References Cited

U.S. PATENT DOCUMENTS

| | | | | |
|---|---|---|---|---|
| 4,733,033 | A | 3/1988 | Morris et al. | |
| 6,396,018 | B1 * | 5/2002 | Kinoshita et al. | 218/154 |
| 2009/0057112 | A1 | 3/2009 | Bennett et al. | |
| 2009/0321233 | A1 | 12/2009 | Ferree | |
| 2010/0044196 | A1 * | 2/2010 | Dahl et al. | 200/244 |
| 2012/0186955 | A1 | 7/2012 | Birner et al. | |

FOREIGN PATENT DOCUMENTS

| | | | |
|---|---|---|---|
| CN | 2640027 | Y | 9/2004 |
| DE | 19624780 | A1 | 1/1998 |
| DE | 102007040163 | A1 | 2/2009 |
| DE | 102008039066 | A1 | 2/2010 |
| DE | 112007003283 | T5 | 2/2010 |
| DE | 102011075655 | A1 | 2/2012 |
| DE | 102011003131 | A1 | 7/2012 |
| EP | 1229566 | A1 | 8/2002 |
| WO | WO 2005059941 | A1 | 6/2005 |

OTHER PUBLICATIONS

Allround Lubricant Hochleistungsfette WEICON, pp. 1-12; Others; DE.

German Office Action for German Application No. DE 10 2011 081 736.0 (Not Yet Published).

(Continued)

*Primary Examiner* — Renee S Luebke
*Assistant Examiner* — Ahmed Saeed
(74) *Attorney, Agent, or Firm* — Harness, Dickey & Pierce, P.L.C.

(57) ABSTRACT

An electrical switch is disclosed, especially a circuit breaker. In addition, a method for improving such a switch is also disclosed. In order to protect an electrical switch in an especially simple manner from contamination and/or damage by erosion materials, it is proposed to cover a few or all functional parts of the switch at least partly with a protective material, wherein the protective material involves a viscous, temperature-resistant mass.

17 Claims, 4 Drawing Sheets

(56) References Cited

OTHER PUBLICATIONS

German Priority Document for German Application No. DE 10 2011 081 736.0 (Not Yet Published).

Anonymos; HOTEMP 2000 High-temperature lubricating oil; pp. 2; Klueber Lubrication; 2007; Feb. 1, 2007.

Office Action for Chinese Patent Application No. 201210311961.5 dated Mar. 9, 2015 with English translation.

* cited by examiner

ELECTRICAL SWITCH

PRIORITY STATEMENT

The present application hereby claims priority under 35 U.S.C. §119 to German patent application number DE 10 2011 081 736.0 filed Aug. 29, 2011, the entire contents of which are hereby incorporated herein by reference.

FIELD

At least one embodiment of the invention generally relates to an electrical switch, especially a circuit breaker. In addition at least one embodiment of the invention generally relates to a method for improving such a switch.

BACKGROUND

Electrical circuit breakers often have a rotary contact system which features two fixed contacts for connection to a respective current path and also a rotatably supported contact element interacting with a least one of the fixed contacts. The movable contact element mostly embodied in the form of a bridge serves to interrupt and close the circuit. An actuation mechanism, for example in the form of a rocker lever, is used for manual switch-on or switch-off. In the event of a short-circuit the contact bridge should open very quickly through electrodynamic forces independently of the actuation mechanism.

During opening of the contact bridge a switching arc occurs between the contacts which, at very high temperatures, leads to a loss of material at the contacts, known as arc erosion. The very hot solid or gaseous erosion products contaminate and/or damage the surfaces within the switch. This can have a significant effect on the opening function of the switch and can lead to malfunctions. Erosion materials accumulate above all on the function elements of the rotary contact system and, on account of the changes in friction conditions produced thereby, prevent the contacts opening properly in the event of a short-circuit.

Various solutions are known from the prior art which are oriented towards avoiding contamination by erosion materials. These mostly involve mechanical sheathing or encapsulation of specific functional parts of the rotary contact system. These types of mechanical solutions are comparatively expensive since they must be implemented within the smallest space without adversely affecting the proper function of the switch.

At least one embodiment of the invention is directed to covering the surfaces of some or all of the functional parts of the switch at least partly with a protective material, with the protective material involving a viscous, temperature-resistant mass. This applies at least for the function of the switch, especially functional parts relevant to the opening function. The mass used prevents the hot erosion materials being deposited or accumulating on the functionally-relevant subsurfaces and thereby contaminating or damaging said surfaces. This ensures that the proper opening of the switch is not impeded even after a repeated occurrence of erosion materials.

SUMMARY

At least one embodiment of the present invention provides an electrical switch which is protected in an especially simple manner against contamination and/or damage by erosion materials. Advantageous embodiments of the invention are specified in the subclaims.

BRIEF DESCRIPTION OF THE DRAWINGS

The properties, features and advantages described above of this invention as well as the manner in which these are achieved are explained in a clearer and easier to understand way in conjunction with the following description of exemplary embodiments which are explained in greater detail in conjunction with the drawings, in which.

All figures merely show the invention schematically and with its major components. In the figures the same reference characters identify elements with the same or comparable function.

DETAILED DESCRIPTION OF THE EXAMPLE EMBODIMENTS

Figure 1:
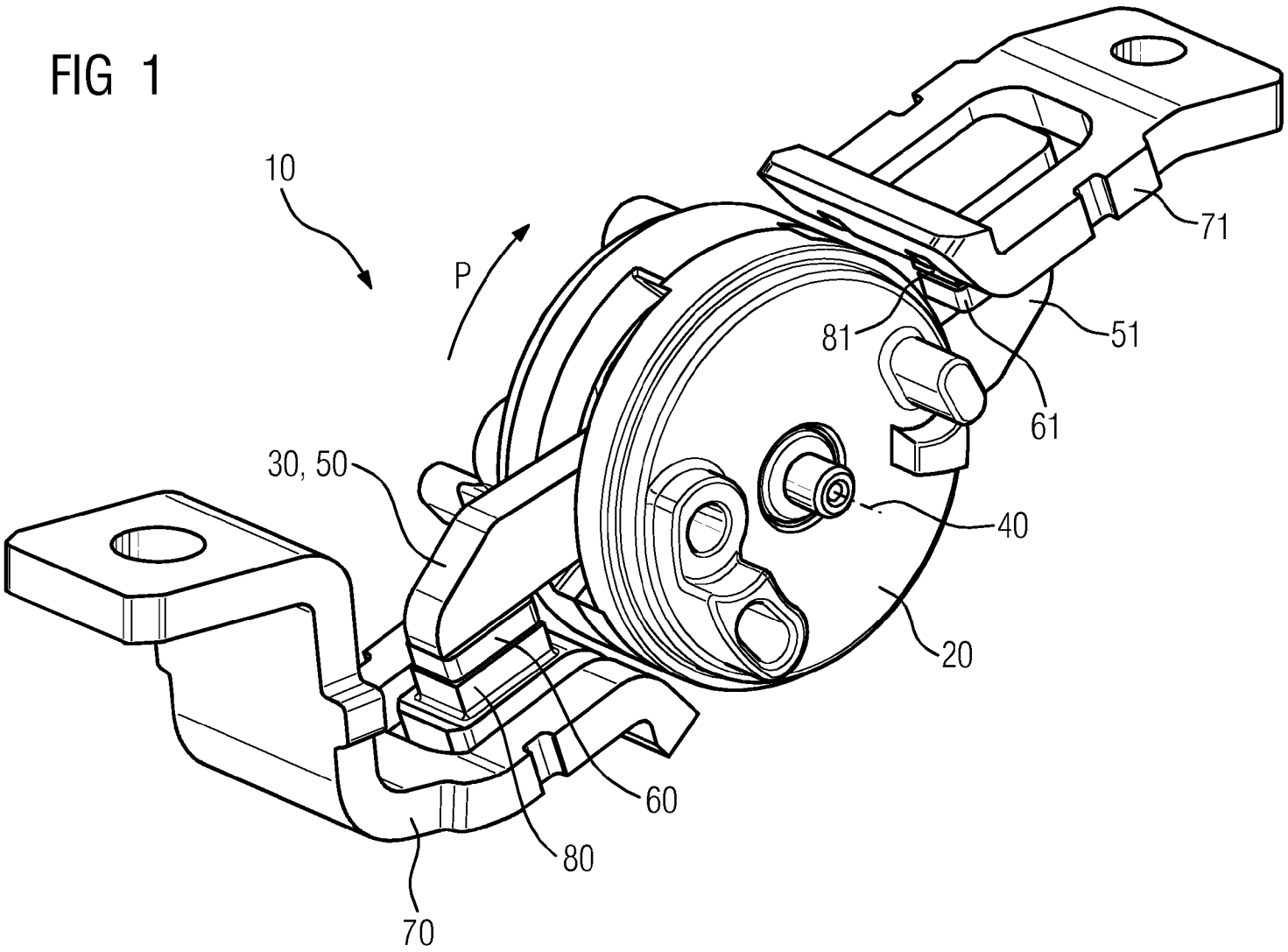
FIG. 1 shows an embodiment of an inventive switch in a perspective view (switched-on state)

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment of the invention is directed to covering the surfaces of some or all of the functional parts of the switch at least partly with a protective material, with the protective material involving a viscous, temperature-resistant mass. This applies at least for the function of the switch, especially functional parts relevant to the opening function. The mass used prevents the hot erosion materials being deposited or accumulating on the functionally-relevant subsurfaces and thereby contaminating or damaging said surfaces. This ensures that the proper opening of the switch is not impeded even after a repeated occurrence of erosion materials.

At least one embodiment of the invention can be used for all switches in which contamination by erosion materials occurs, but especially for circuit breakers such as compact circuit breakers for example.

The protective material used is viscous. The minimum viscosity of the basic substances used for the protective material preferably amounts to 300 mm2/s at 40° C. (DIN 51562).

The protective material used is preferably permanently elastic and returns to its initial form at the end of a force acting on it immediately or in an acceptably short time for the application. This reset capability is preferably so marked that the material completely or at least almost completely assumes its initial form again. Preferably the material involved is a non-hardening, paste-like, moldable material which retains its elastic properties, especially its resetting force, in the range of temperatures that occurs.

The moldable characteristic of the material used is preferably characterized by a viscoelastic behavior, in other words the material exhibits a partly elastic, partly viscous behavior. As well as such a mixture of elastic (springing) properties and viscous (damping) properties, plastic properties can also occur, which make it possible for mechanical elements of the electrical switch to slide on the protective material. Depending on the purpose for which it is used and the place in which it is used in the switch, the protective material can thus also exhibit and elastoplastic, a plastoelastic or another deformation property.

The protective material involves a temperature-resistant material with an ability to withstand temperatures of at least 200° C. This means that the material is chemically stable up to this temperature and retains its mechanical properties, especially in respect of its elasticity. The protective material is selected such that it withstands the high temperatures in the vicinity of the arc and does not burn off or evaporate when the arc is burning.

Above and beyond this the protective material used preferably has a high adhesion capability. A defined minimum adhesion ensures that the material remains in the intended areas and does not spread to other areas of the switch in which there is no requirement for coverage with protective material.

The protective material preferably involves a grease, especially a lubrication grease. This has the advantage that the protective material not only protects the functional surfaces or receiving volume to be protected from deposits of erosion materials or other contamination. At the same time the protective material also serves as a lubrication or sliding means and thereby reduces the mechanical friction and wear. By contrast with other materials able to be applied to surfaces, such as oils or the like, grease also does not drip off but remains at the lubrication point.

Despite concerns often being expressed about the use of an insulating grease material in the contact area, the use of grease in the application described is possible without any problems since the grease, because of its adhesion properties, remains at the lubrication points and thus does not come into contact with those functional elements which ensure that current flows through the switch.

At least one embodiment of the present invention can be used to particular advantage in electrical switches in which a rotary contact system is used and a hingable contact arm is arranged in a rotor housing. In this case the inside of the rotor housing frequently embodies, at least in some areas, functional elements or parts of functional elements which are of importance for the function of the switch, especially the opening function and which are provided with the protective material.

The application of the protective material is particularly advantageous for electrical switches, as are described for example in German patient DE 10 2008 039 066 A1 or in the previously unpublished German patent application "Elektrischer Schalter" (electrical switch) by the same applicant, dated 25 Jan. 2011 (DE 10 2011 003 131), the entire contents of each of which is hereby incorporated herein by reference. In this document a functional element is provided which holds the contact arm while forming a mechanical connection to the rotor housing and is moved away in the event of a relative rotation between the contact arm and the rotor housing.

The functional element is moved away in such cases along at least one functional surface of the rotor housing and is moved such that the functional element touches the functional surface, for example being supported on it, and/or the functional element is moved away such that the functional element moves into a receiving volume of the rotor housing or moves along an empty volume. In other words the rotor housing has areas relevant to functional integrity in the form of surfaces and/or receiving or empty volumes which are inventively covered with the protective material.

A receiving volume in such cases is to be understood as a volume which is embodied to completely or partly receive the functional element, for example to provide an end position of the functional element.

An empty volume in this case is to be understood as a volume that—because of mechanical specifications for example—is empty and is not intended to receive the functional element. An empty volume typically obtains its meaning for the function of the switch from the fact that a functional element, when carrying out its function is moved past the empty volume or along the empty volume and erosion materials would prevent this movement were they to fill the empty volume or project beyond the already filled empty volume out into the movement path of the functional element.

Expressed in different terms, the protective material can advantageously be used in switches with rotary contact systems such that on the one hand it is used as a protective layer in order to cover functional surfaces. In this way it prevents erosion products accumulating on the surfaces and in doing so, increasing the sliding friction during opening of the electrical switch. On the other hand the protective material can also be used as a filler material for volumes. The material closes off the volume and thus prevents erosion products accumulating in the volume and filling out the volume needed for the function of the switch. Receiving volumes are kept free for the functional element of the switch. The undesired filling of empty volumes is prevented.

In one embodiment of the invention the protective material is applied to the surfaces of the functional parts manually, for example by being painted on, preferably using a brush. In another embodiment of the invention the protective material is injected with the aid of a spray nozzle, for example via correspondingly provided filler openings in the rotor housing. In this case the protective material is distributed on the surfaces preferably via the inherent movement of the protective material. The injection can be automated.

Embodiments of the invention are not restricted to the protection of electrical switches with a rotary contact system but can also be used for other types of switch.

FIG. 1 shows an electrical switch 10 with a rotary contact system, as is described in the still unpublished German patent application "Elektrischer Schalter" (electrical switch) by the same applicant dated 25 Jan. 2011 (DE 10 2011 003 131), the entire contents of which are hereby incorporated herein by reference.

The rotor housing 20 can be rotated along the direction of the arrow P around the axis of rotation 40. Located within the rotor housing 20 is a contact bridge 30, which together with the rotor housing 20 or also relative to the rotor housing 20, is likewise able to be hinged along the direction of the arrow P around the axis of rotation 40.

The contact bridge 30 is formed by a first contact arm 50 and also a second contact arm 51. Each of the two contact arms 50 and 51 is provided at its end with a contact element 60, 61.

Two fixed contact rails 70, 71 act together with the contact bridge 30. For this purpose the two contact rails 70, 71 are each equipped with a fixed contact element 80, 81.

In the position shown in FIG. 1 the switch 10 is closed, so that an electrical current can flow from the contact rails 70 via the contact bridge 30 to the contact rails 71. To make this flow of current possible, the contact elements 60 and 61 of the contact bridge 30 rest against the corresponding fixed contact elements 80, 81 of the two contact rails 70, 71.

Figure 2:
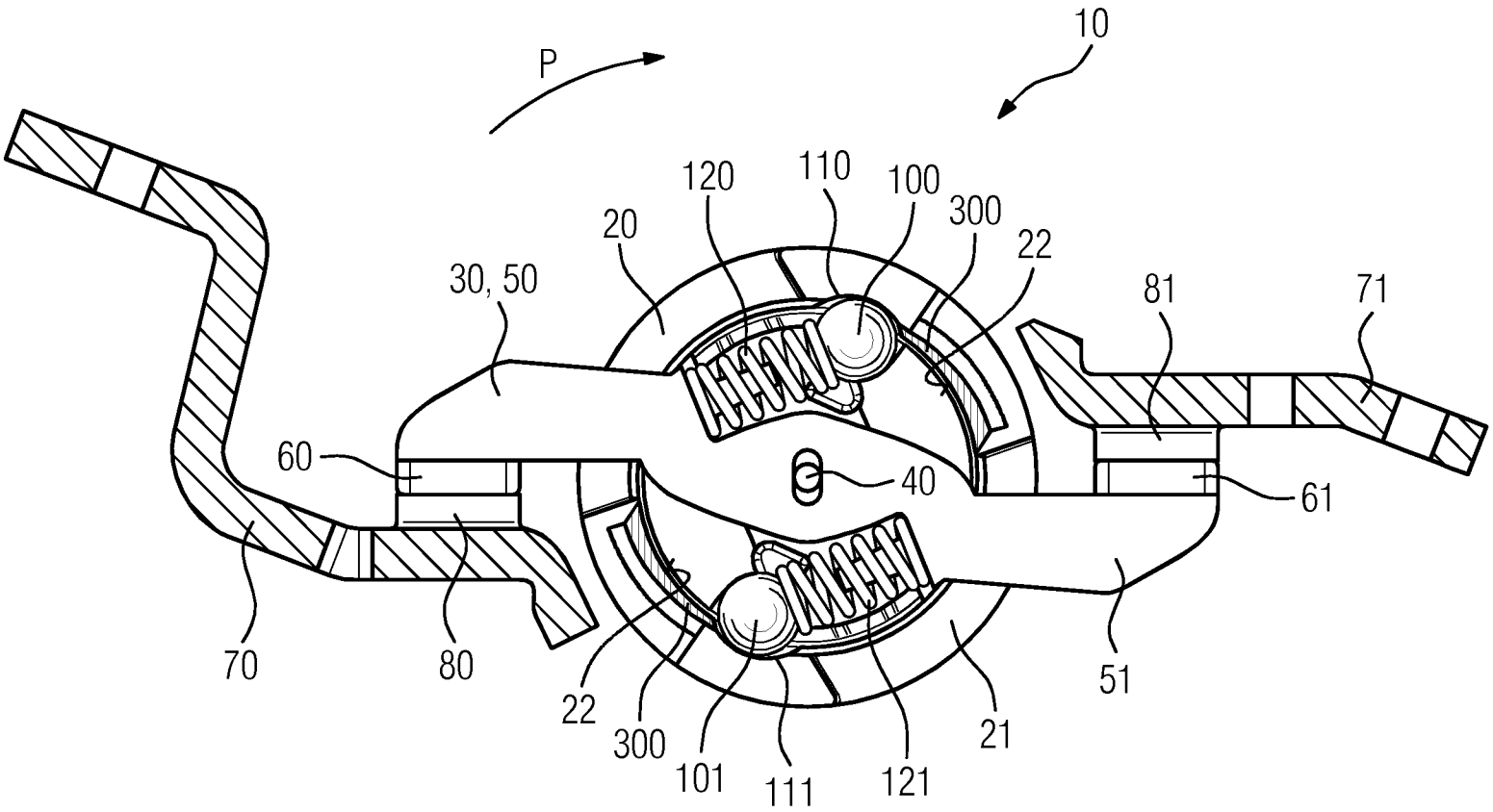
FIG. 2 shows the switch from FIG. 1 in cross-section (switched-on state)

FIG. 2 shows a cross section of the switch 10 in the switched-on state. The rotor housing 20 comprises a housing shell 21 with an edge section, having an edge inner surface 22. The edge inner surface 22 forms a wall section on which two intermediate parts in the form of balls 100, 101 can slide and/or roll.

In the switched-on state of switch 10 the two balls 100, 101 are located in first recesses 110, 111 in the inner edge surface 22, in which they are held under spring pressure by springs 120, 121. The two first recesses 110, 111 thereby define a first latching position for the contact bridge 30 and two balls 100, 101.

The two balls 100, 101 form separate parts which are neither mechanically connected to the housing shell 21 nor to the rotor housing 20, nor to the contact bridge 30. The balls 100, 101 involve separate components which are merely held clamped under spring pressure between the housing shell 21 of the rotor housing 20 and the contact bridge 30 by the two springs 120, 121.

To install the switch 10 the two balls 100, 101 must therefore merely be inserted into the recesses 110, 111 and clamped there by means of the two springs 120, 121.

The two springs 120, 121 each have two spring ends, of which a first spring end presses directly onto one of the two balls and of which the second spring end is supported on one of the contact arms of the contact bridge 30. In order to guarantee an even transmission of force, one of the two springs 120 is supported on the first contact arm 50 of the contact bridge 30 and the other spring 121 on the second contact arm 51 of the contact bridge 30.

Thus only the rotor housing 20, the contact bridge 30, the two balls 100, 101 and also the two springs 120, 121 are required to define the first latching position of the contact bridge 30 shown in FIG. 2.

If the current which flows via the contact bridge 30 from the one contact rails 70 to the other contact rails 71 or vice versa, exceeds a threshold value, magnetic forces act indirectly or directly on the contact bridge 30, through which the contact bridge 30 will be hinged along the hinge direction P. This hinging movement occurs here relative to the rotor housing 20. In the event of such a hinging movement the two springs 120, 121 which are resting against the contact bridge 30, will exert a pressure force on the two balls 100, 101 and push these out of their recess 110 or 111. After being pushed out in this way the two balls 100 and 101 will roll along the internal edge surface 22 of the housing shell 21 in the direction of the arrow P.

Figure 3:
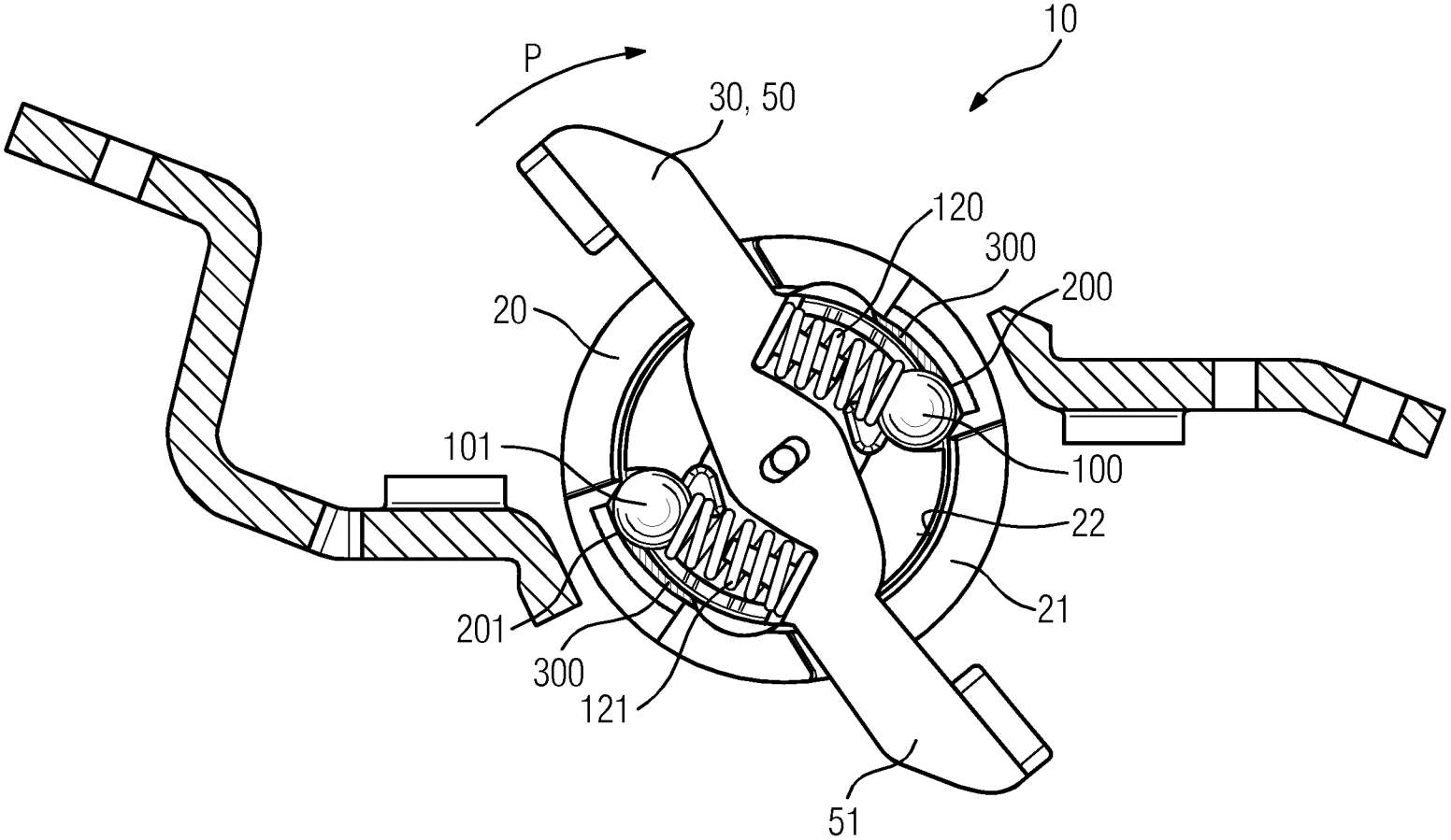
FIG. 3 shows the switch from FIG. 1 in cross-section (switched-off state) and FIG. 4 shows an enlarged detail from FIG. 2.

FIG. 3 shows the state of the switch 10 after the contact bridge 30 has been hinged relative to the rotor housing 20. As a result of the hinging of the contact bridge 30, the balls 100, 110 will be rolled off the internal contact surface 22 of the housing shell and bought in each case into a second latching position of the contact bridge 30. This second latching position is defined by second recesses 200, 201 in the inner edge surface 22. The two balls 100, 101 are also held under spring pressure in the second latching position, and this is also done by the two springs 120, 121 which are supported on the two contact arms 50, 51 of the contact bridge 30.

The second latching position guarantees that the open switching state of the contact elements can also latch and the switch also remains open if the release current which has brought about the rotation of the contact bridge 30 decays once again.

The balls 100, 101 described above are functional elements of the rotary contact system of the switch 10. They hold the contact arms 50, 51 of the contact bridge 30 while embodying a fixed mechanical connection with the rotor housing 20 and are moved away in the event of a relative rotation between the contact arms 50, 51 and the rotor housing 20.

The balls 100, 101 are moved away in such cases at least from the functional surface of the rotor housing 20, namely sliding on the internal edge surface 22 of the housing shell 21 out of the recesses 110, 111 and into the recesses 200, 201, which form receiving volumes for the balls 100, 101. These functional surfaces involve surfaces of functional parts of the switch 10, which are relevant to the function of the switch 10, especially the opening function. In other words, in the exemplary embodiment described, the first and the second recesses 110, 111, 200, 201 on the one hand form receiving volumes. On the other hand the recesses 110, 111, 200, 201 simultaneously serve as functional surfaces, along which the balls 100, 101 move in a sliding or rolling motion.

In accordance with an embodiment of the invention there is now provision to cover some of these areas at least partly with a protective material 300 for protecting against contamination and/or damage by erosion materials, wherein the protective material 300 involves a viscous, temperature-resistant mass, in this case a lubricating grease. A high-temperature grease can be used as the protective material 300, wherein for example Teflon or ceramic-based high-temperature greases are suitable. Likewise high-temperature hybrid greases can be used as protective material 300 which represents a mixture of mineral greases and Teflon-based greases. Silicon-based masses can also be considered as viscous, temperature-resistant mass of the protective material 300.

The surfaces to be provided with the protective material 300, in the example embodiment shown here, involve the recesses 200, 201 which define the second latching position. The second recesses 200, 201 are embodied as wedge-shaped receiving volumes continuously deepening in the direction of rotation P and immediately adjoin the first recesses 110, 111.

Figure 4:
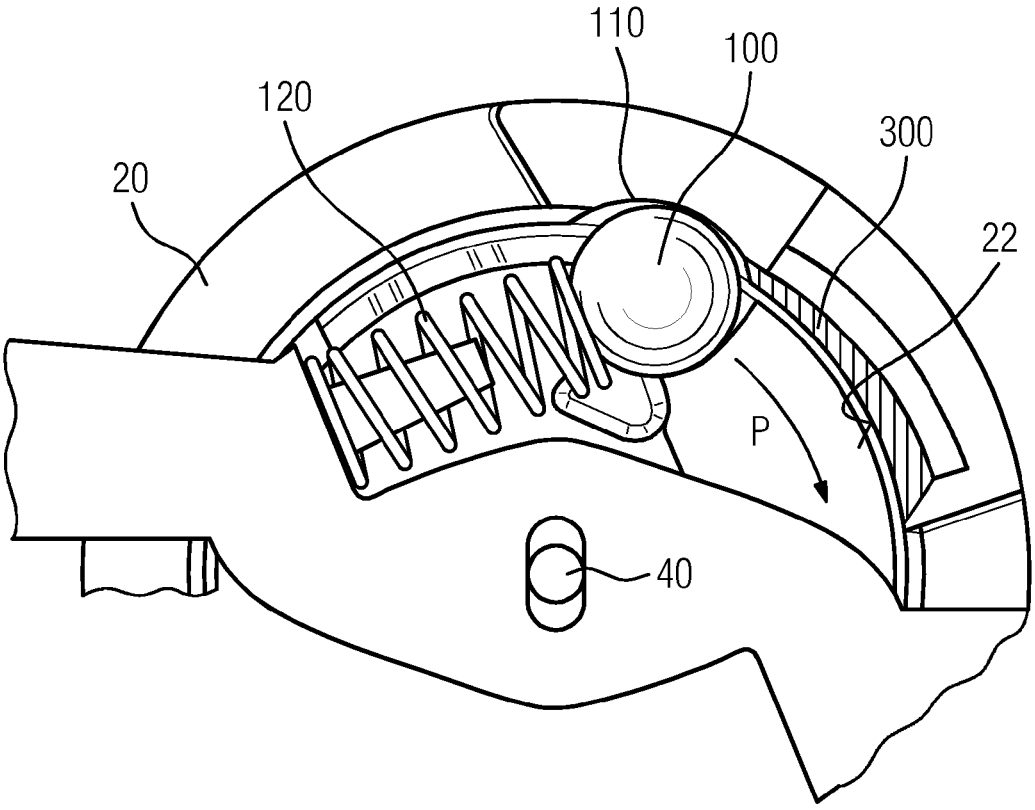

The recesses 200, 201 are partly filled with grease. The filling inserted into the recesses 200, 201 closes them off at least partly and thus prevents erosion products accumulating therein, as a result of which the recesses 200, 201 are kept free to receive the balls 100, 101, cf. the detailed view in FIG. 4 in this context. If the balls 100, 101 move into the second recesses 200, 201 the protective material 300 yields. The material 300 is forced out by the balls 100, 101 and thus allows the balls 100, 101 to be received into the receiving volumes and finally the positioning of the balls 100, 101 in these second latching positions, as shown in FIG. 3. After resetting of the switch 10 the protective material 300 assumes its original shape again and closes off the recesses 200, 201.

The protective material does not impede the functioning of the switch 10. Orderly switching processes remain guaranteed. At the same time contamination of and damage to the functional parts 200, 201 by erosion materials is prevented in a simple and low-cost manner.

Although the invention has been illustrated more closely and described in detail by the preferred exemplary embodiment, the invention is not restricted to the disclosed examples and other variations can be derived herefrom by the person skilled in the art, without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Electrical switch
20 Rotor housing
21 Housing shell
22 Inner edge surface
30 Contact bridge
40 Axis of rotation
50 First contact arm
51 Second contact arm
60 First contact element
61 Second contact element
70 First contact rail
71 Second contact rail
80 First contact element
81 Second contact element
100 First ball
101 Second ball
110 First recess
111 First recess
120 Spring
121 Spring
200 Second recess
201 Second recess
300 Protective material

What is claimed is:

1. An electrical switch, comprising:

a rotor housing including a housing shell, the housing shell having an outer edge on a peripheral exterior surface of the housing shell and an internal edge on a peripheral interior surface of the housing shell, and at least one recess formed on the housing shell;

at least one rotatable ball in the housing shell; and a protective material covering a surface of at least the at least one recess with the protective material to protect against at least one of contamination and damage by erosion materials, wherein the protective material involves a viscous, temperature-resistant mass, wherein the internal edge forms a wall section of the rotor housing on which the at least one hall rotatable engages.

2. The electrical switch of claim 1, further comprising:

a rotary contact system in which at least one hingable contact arm is disposed in the rotor housing, wherein an inside of the rotor housing is covered at least partly by the protective material.

3. The electrical switch of claim 2, wherein areas of the inside of the rotor housing, which insure as functional elements the correctly functioning hinging of the at least one contact arm are covered with the protective material.

4. The electrical switch of claim 2, wherein the at least one contact arm is rotatably supported in the rotor housing and is able to be hinged between an on and an off position as well as relative to the rotor housing and at least one intermediate part is provided which, in a position, holds the at least one contact arm by making a mechanical connection to the rotor housing and, in the event of a relative rotation between the at least one contact arm and the rotor housing, is moved back from the positions such that the at least one intermediate part, during the movement away, at least one of moves while touching the internal edge of the rotor housing, moves into at least one receiving volume provided in or on the rotor housing and is moved along an empty volume, wherein the at least one intermediate part and the at least one receiving volume or empty volume is provided with the protective material.

5. The electrical switch of claim 4, wherein the protective material covers the internal edge as a protective layer.

6. The electrical switch of claim 4, wherein the at least one receiving volume is at least partly filled with protective material.

7. The electrical switch of claim 1, wherein the basic substance used for the protective material includes a viscosity of at least 300 $mm^2/s$ at 40° C. (DIN 51562).

8. The electrical switch of claim 1, wherein the protective material is resistant to temperatures of up 200° C.

9. The electrical switch of claim 1, wherein the protective material involves a grease.

10. The electrical switch of claim 1, wherein the electrical switch is a circuit breaker.

11. The electrical switch of claim 1, wherein at least one of the functional parts is relevant to an opening function.

12. The electrical switch of claim 3, wherein the at least one contact arm is rotatably supported in the rotor hot sing and is able to be hinged between an on and an off position as well as relative to the rotor housing and at least one intermediate part is provided which, in a position, holds the at least one contact arm by making a mechanical connection to the rotor housing and, in the event of a relative rotation between the at least one contact arm and the rotor housing, is moved back from the positions such that the at least one intermediate part, during the movement away, at least one of moves while touching the internal edge of the rotor housing, moves into at least one receiving volume provided in or on the rotor housing and is moved along an empty volume, wherein at least one of the internal edge and the at least one receiving volume or empty volume is provided with the protective material.

13. The electrical switch of claim 2, wherein the basic substance used for the protective material includes a viscosity of at least 300 $mm^2/s$ at 40° C. (DIN 51562).

14. The electrical switch of claim 2, wherein the protective material is resistant to temperatures of up 200° C.

15. The electrical switch of claim 2, wherein the protective material involves a grease.

16. The electrical switch of claim 1, further comprising a spring engaged at a first end with the at least one ball and the at least one ball is between the at least one ball and the recess.

17. The electrical switch of claim 3, wherein the housing shell in includes a receiving volume in which the functional elements reside and an empty volume, and wherein the empty volume is fitted with the protective material.

* * * * *